United States Patent [19]

Lipsitz

[11] Patent Number: 4,986,421

[45] Date of Patent: Jan. 22, 1991

[54] BLISTER CARD SET

[76] Inventor: Larry Lipsitz, 1573 Heather Croft Dr., Chesterfield, Mo. 63017

[21] Appl. No.: 459,476

[22] Filed: Jan. 2, 1990

[51] Int. Cl.[5] ..... B65D 73/00

[52] U.S. Cl. ..... 206/459; 206/461; 206/486; 206/806

[58] Field of Search ..... 206/459, 460, 461–471, 206/477, 481, 486, 806

[56] References Cited

U.S. PATENT DOCUMENTS

| | | | |
|---|---|---|---|
| 571,521 | 11/1896 | Heberline | 206/461 |
| 1,876,181 | 9/1932 | Tussing | 206/459 |
| 2,956,677 | 10/1960 | Kavadlo et al. | 206/464 |
| 3,291,300 | 12/1966 | Rosen | 206/471 |
| 3,339,728 | 9/1967 | Werner | 206/461 |
| 3,770,120 | 11/1973 | Hanson | 206/459 |
| 3,856,144 | 12/1974 | Kelly | 206/469 |
| 3,861,528 | 1/1975 | Damuth | 206/463 |
| 3,870,144 | 3/1975 | Hanson | 206/459 |
| 4,058,220 | 11/1977 | Torongo | 206/461 |
| 4,619,364 | 10/1986 | Czopor, Jr. | 206/470 |

*Primary Examiner*—Jimmy G. Foster

*Attorney, Agent, or Firm*—Kalish & Gilster

[57] ABSTRACT

A set of cards for display of small merchandise comprises at least two cards for attachment of merchandise items by a plastic bubble, or blister, or other methods. The cards may be displayed in stacked, or aligned, fashion with front and back surfaces of adjacent cards facing each other. A tab is provided along the same edge of each card for supplying specific information about the products displayed. The information tabs are formed at staggered positions along the respective card edges for easy visibility during display of the set.

4 Claims, 1 Drawing Sheet

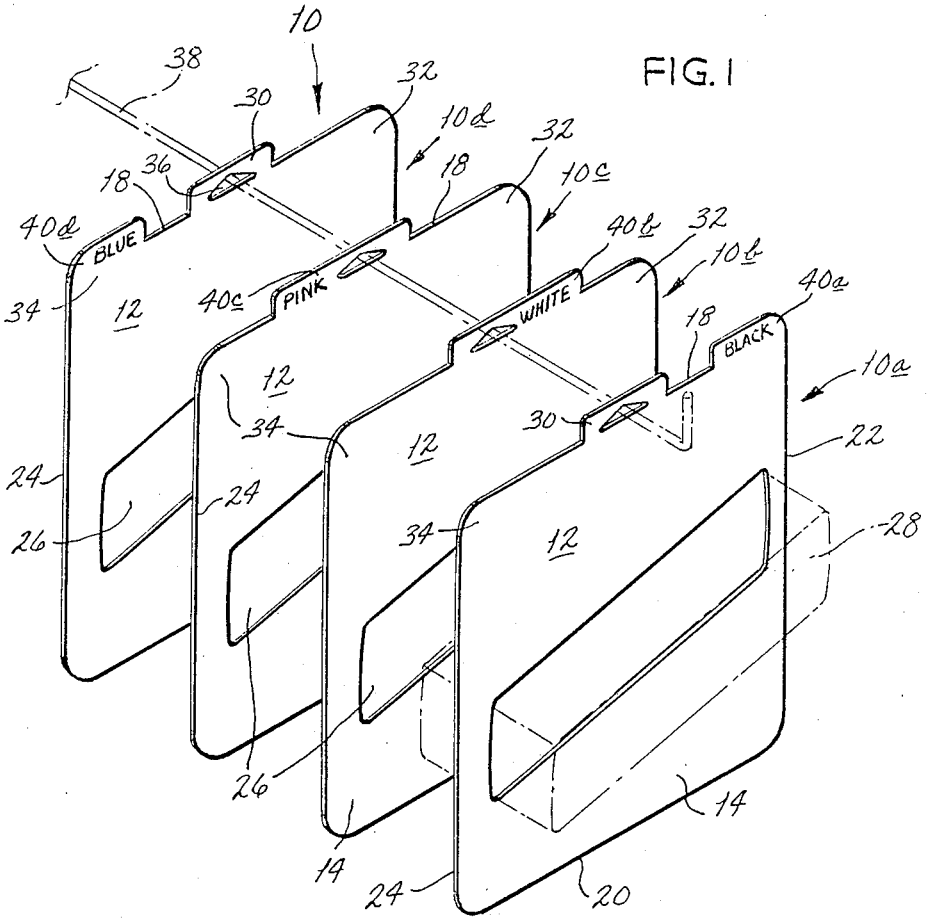
FIG. 1
FIG. 2
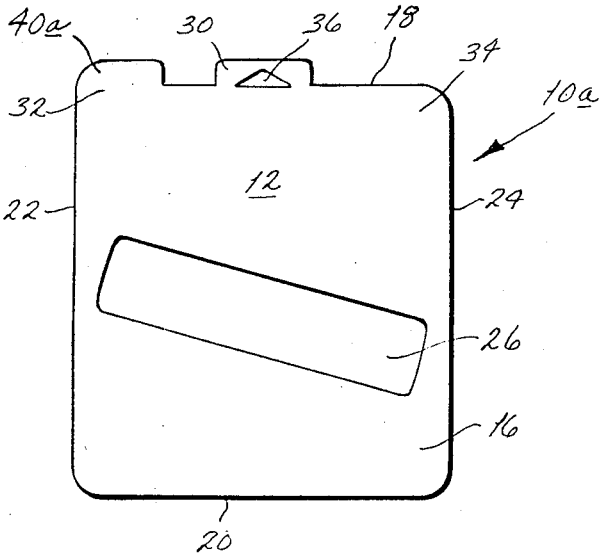
FIG. 3
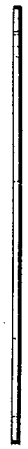

BLISTER CARD SET

BACKGROUND AND SUMMARY OF THE INVENTION

This invention relates generally to the field of product display cards and, more particularly, to a set of display cards having identification tabs integrally formed and positioned on their respective cards so as to be staggered and easily viewable when the cards are arranged for display.

Heretofore, various types of product display cards have been commonly known. Small items may be attached to display cards, boards, or the like, by means of staples, glue or a surrounding plastic bubble or blister. The cards having products attached may then be arranged for display, for example, in a wooden or plastic rack having grooves to receive the cards or by suspending the same from a hook or rod. Often, items displayed in this manner consist of different varieties of the same type of merchandise, that is, the merchandise may be of different colors, decorated differently, or of different sizes, yet all displayed on the same rod or hook. Such an arrangement has the inherent drawback that cards rearward on the hook or rack are difficult to see; therefore, the shopper is required to either push the forwardmost display cards aside or actually remove them from the rack in order to view information supplied on the rearward cards in an attempt to find the product for which he or she is searching.

Therefore, it is an object of the present invention to provide a set of display cards having information positioned on the cards in such a manner so as to provide easy visibility of information thereon without requiring movement of the cards on the rack.

It is another object of the present invention to provide a set of display cards having the features indicated in which the information contained may include identifying material such as words or actual color indicating the color of the product attached to the card.

It is a further object of the present invention to provide a set of display cards having the features indicated in which a product may be attached to a card by insertion thereof into an opening within the body of the card and may be selectively retained therein by addition of a plastic bubble or blister around the product and/or around the card.

It is a still further object of the present invention to provide a set of display cards having the features indicated which may consist of at least two or many more of such cards, the different cards being readily distinguishable from each other when displayed It is yet another object of the present invention to provide a set of display cards having the features indicated which is simple to manufacture as well as being inexpensive and easy to use.

Briefly, in furtherance of the above objects, the present invention comprises a set of product display cards comprising at least a first and a second of said cards. Each of the cards comprises a body having a front surface and a back surface, a top edge, a bottom edge, opposing side edges, and an attachment for vertically positioning the cards in relative alignment such that the back surface of the first card is adjacent to the front surface of the second card, and so on. An identification tab is formed on, and extends from, an edge of each card so that when the cards are displayed adjacent to each other, the respective tabs on the cards are relatively staggered in position so as to be plainly viewable.

Other objects and features will be in part apparent and in part pointed out hereinbelow.

BRIEF DESCRIPTION OF THE DRAWINGS

FIG. 1 is an elevational view of a set of product display cards constructed in accordance with and embodying the present invention positioned upon a display rod.

FIG. 2 is a rear view of card 10*a* of the set shown in FIG. 1.

FIG. 3 is a side edge view of the card of FIG. 2.

DESCRIPTION OF THE PREFERRED EMBODIMENT

Referring now by reference characters to the drawings which illustrate the preferred embodiment of the present invention, 10 generally indicates a set of product display cards 10*a*, 10*b*, 10*c* and 10*d* in consecutive order. Cards 10*a* through 10*d* are generally the same and have like parts similarly numbered. Each card 10*a* through 10*d* consists of a preferably flat, cardboard body 12 having a front surface 14 (FIG. 1) and a rear surface 16 (FIG. 2). If desired, body 12 may be interrupted by an opening 26 for receiving and retaining merchandise, not shown, but indicated in phantom at 28, such as a camera or other small item. A top edge 18, bottom edge 20 and opposing side edges 22 (FIG. 3), 24 define the perimeter of body 12. Body 12 is substantially rectangular and has shoulders, or corners, 32, 34 defining the intersections of top edge 18 and side edges 22, 24. Integrally formed and extending upwardly from approximately the center of top edge 18 is a flange 30 having an aperture 36 for penetration therethrough by a display rod 38, shown in phantom. Suspension of cards 10*a* through 10*d* on rod 38, (FIG. 1) or alternatively, in a rack, not shown, with supporting grooves for receiving lower edge 20 permits the display cards 10*a* through 10*d* to be positioned consecutively, one in front of the other. Thus, back surface 16 of card 10*a* is facing front surface 14 of card 10*b*, and so on throughout set 10 as displayed.

Along top edge 18 is formed an integral identification or information tab, such as 40*a*, 40*b*, 40*c*, or 40*d* on respective cards 10*a*, 10*b*, 10*c*, 10*d*, such that the position of tabs 40*a* through 40*d* are staggered when cards 10*a* through 10*d* are positioned as previously described (FIG. 1). That is, if tab 40*a* is positioned at shoulder 32 of card 10*a*, tab 40*b* would be positioned between flange 30 and shoulder 32 of card 10*b*, tab 40*c* would be positioned between flange 30 and shoulder 34 of card 10*c* and tab 40*d* would be positioned between flange 30 and shoulder 34 of card 10*d*. Given the described arrangement, information such as various colors printed or shown on the information tabs 40*a* through 40*d* would be visible to the consumer without requiring movement of the cards 10*a* through 10*d* on rod 38 or removal therefrom.

Thus, as shown and described, display card set 10 may be used, for example, with a black camera attached to card 10*a* and tab 40*a* having the word "black" on a black background; card 10*b* which might carry a white camera and tab 40*b* stating the word "white" on a white background; card 10*c* which might retain a pink camera and tab 40*c* stating "pink" on a pink background and card 10*d* which might carry a blue camera having tab 40*d* stating "blue" on a blue background, yet each tab may be facilely observed and the color of the attached camera noted without moving cards 10a–10d. Thus, for example, if the consumer is searching for a red camera, the product display need not be even touched.

As may be readily seen, the number and variation of items for which this presently claimed display card set 10 may be used is limitless. The range of products for which the present invention would be useful to display varies from cosmetics to automobile fuel filters and including everything in between. In addition to being very simple to use, the present invention is also inexpensive to manufacture and therefore will not substantially increase the cost of the product with which it is used.

As is obvious, the number of cards in set 10 may be of any number, although the advantage of greater visibility of product information is especially apparent when more than a few such cards 10a–10d are utilized. Other alternative forms of the invention include manufacturing display card set 10 of a material other than cardboard, such as plastic, providing cards 10a–10d in a shape other than rectangular (e.g., circular or hexagonal); varying the number of possible sites along edge 18 for positioning information tabs similar to those shown at 40a–40d; and providing cards, or boards 10a–10d (at least two in number) in a construction other than flat (i.e., in three-dimensional forms, possibly having a vertical cross-section, triangular or trapezoidal in shape yet capable of being suspended and labeled as shown). Additionally, the merchandise may be attached to the display card, such as 10a–10d by glue or staples, for example. Addition of a commonly used clear plastic bubble, or blister (not shown), formed either over the product alone or over an entire card (10a–10d) retaining such product, may be used to supplement any such product attachment, including that shown at 26, 28.

When used as described, card set 10 permits a consumer to quickly glance at a rack of merchandise and readily determine whether the type, color or size, for example, which he desires, is indeed present on the display. Accordingly, less merchandise is disturbed on the display racks and time is saved both by the consumer in viewing the merchandise and by the store personnel, in not having to rearrange or straighten up the confused display which would otherwise result.

In view of the foregoing, it will be seen that the several objects of the invention are achieved and other advantages are attained.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. A set of product display cards oriented in a sequential series of a plurality of cards in registry, each of the cards comprising a body having a front surface and a back surface, a top edge, a bottom edge, and opposing side edges, an aperture provided in each card for receiving a rod or the like suspension device for vertically suspending each card, the apertures establishing stacked registry of the cards with the respective side edges, bottom edges and portions of top edges of each card being in alignment with each other card, but without recourse to external structure for support, and an identification tab formed on and extending from the top edge of each card at a position staggered relative to that of the corresponding tab of each other card in the set whereby, when the cards are displayed in such relative alignment, the view of each tab is unobstructed when viewed from the front of the set.

2. A set of display cards as recited in claim 1, wherein each of the identification tabs is formed along the top edge of the respective card and is colored and the name of the color is at least one of the printed items appearing on the tab.

3. A set of display cards as recited in claim 1, wherein the card body comprises an opening for positioning the product therein.

4. A set of display cards as recited in claim 1, wherein each card further comprises an integral flange formed on the top edge of the respective cards, the integral flange having said aperture.

* * * * *